United States Patent [19]

LaRossa et al.

[11] Patent Number: 4,960,277

[45] Date of Patent: Oct. 2, 1990

[54] FOLDABLE WEIGHT LIFTER'S BENCH

[76] Inventors: Bernard J. LaRossa, 51-F Cabblestone Dr.; Mark A. Maidenburg, 51-H Cobblestone Dr., both of Chico, Calif. 95928

[21] Appl. No.: 462,145

[22] Filed: Jan. 8, 1990

[51] Int. Cl.[5] ..... A63B 21/078

[52] U.S. Cl. ..... 272/123; 272/144

[58] Field of Search ..... 272/93, 117, 118, 123, 272/134, 144, DIG. 4

[56] References Cited

U.S. PATENT DOCUMENTS

| | | | |
|---|---|---|---|
| 3,545,784 | 12/1970 | Delinger . | |
| 4,098,502 | 7/1978 | Faust . | |
| 4,383,684 | 5/1983 | Schliep | 272/123 X |
| 4,412,678 | 11/1983 | Baynes . | |
| 4,423,865 | 1/1984 | Mahnke . | |
| 4,431,181 | 2/1984 | Baswell . | |
| 4,597,553 | 7/1986 | Rorabaugh | 272/144 X |
| 4,609,192 | 9/1986 | Bratcher . | |
| 4,645,196 | 2/1987 | Christie | 272/123 |
| 4,705,267 | 11/1987 | Jackson . | |
| 4,832,336 | 5/1989 | Lahman | 272/134 X |

*Primary Examiner*—Robert Bahr

[57] ABSTRACT

A light weight foldable weight lifter's bench. The bench is equipped with adjustable barbell receivers and a positionable back support. A fold up frame supporting a hard backed padded top bench pad can be quickly folded nearly to a flat position for storage in minimal storage areas such as under a bed.

9 Claims, 4 Drawing Sheets

FOLDABLE WEIGHT LIFTER'S BENCH

BACKGROUND OF THE INVENTION

1. Field of the Invention

This invention relates to portable benches equipped for weight lifting. The present invention is particularly directed towards a weight lifter's bench having supports for barbell exercising and the bench being sufficiently foldable for easy storage under a bed.

2. Description of the Prior Art

Past art patents illustrate a variety of weight lifter's benches having various types of take-a-part structure and changeable platforms. A foldable platform with the versatility of the immediate invention was not seen in patents found in a past art patent search conducted in the classes and subclasses 272/144, 141, 134, 126, 118, 68, 67, and 123. Those patents considered most pertinent to our invention included the following:

1. U.S. Pat. No. 3,545,748, dated Dec. 8, 1970, issued to Delinger. An adjustable slant board is shown in this patent.

2. In a patent dated Jul. 4, 1978, U.S. Pat. No. 4,098,502, a multi-purpose exercising bench is illustrated which converts to many uses without requiring use of tools.

3. U.S. Pat. No. 4,423,865, issued to Mahnke on Jan. 3, 1984, is further illustrative of weight lifter benches having adjustability. The Mahnke bench illustrations do not show foldability for storage.

4. The Baynes "saddle" shown in U.S. Pat. No. 4,412,678, dated Nov. 1, 1983, shows a weight lifter's bench with the upper portion of the back rest adjustable relative to the bar receiver. No fold up features are shown.

5. The wind load device shown in U.S. Pat. No. 4,705,267, issued to Jackson on Nov. 10, 1987, is a rather complicated exercising station which can be taken apart and reassembled for different uses. Although the exerciser can be dismantled in a variety of pieces, the take-a-part sections are directed towards use changes rather than simple mechanics for storing the device.

6. The exercising table shown in U.S. Pat. No. 4,609,192. dated Sep. 2, 1986, does shown a foldable table with provisions for storing parts snapped to holders under the table. The fold up mechanics appear very similar to those used in most folding picnic tables and some parts must be separated from the table to accomplish the folding.

7. The Baswell collapsible gym apparatus shown in U.S. Pat. No. 4,431,181, dated Feb. 14, 1984, is an exercising device which can be folded into a storage cabinet.

The foregoing seems typical of the art found in adjustable and folding weight lifter benches shown in past art patents. No completely foldable weight lifter's benches having barbell receivers which fold up with the bench were seen in the past art patents nor are any available in the market place at the present time.

SUMMARY OF THE INVENTION

Therefore, in practicing our invention, we have provided a weight lifter's bench which can be folded substantially flat for storage. Our bench includes barbell receivers typically required for weight lifting which fold up with the bench. Though having fold up mechanics, our weight lifter's bench is sufficiently stable unfolded for use to support the heaviest of weight lifters and the bar bells he may require. The invention is structured in the form of a foldable frame which supports an attached padded panel in the manner of a slant board. The padded panel is transversely hinged centrally so a back rest section can be raised and lowered according to the requirements of the user and the padded panel is referred to hereinafter as the pad. The foldable frame when opened for use has a horizontally positioned generally rectangular pad support frame, simply called a pad frame, which is supported at each end by vertically positioned leg frames. The pad frame has a foot end and a head end. The foot end of the pad frame is supported by a tubular leg section formed into a rectangular frame having an elongated tubular foot, a crosswise centrally affixed tubular pivotal support brace, and a tubular cross piece at the top attached pivotally to longitudinal members of the horizontal rectangular pad frame. The foot leg frame includes two end tubular leg members which are vertically positioned when the foldable bench frame is unfolded for use. The foot leg frame is stressed by fold up angled support members attached to the crosswise center tubular pivotal support brace and to a pivotal section in a tubular crosspiece in the pad frame. The pad frame is an elongated generally rectangular frame having longitudinal tubular side members braced centrally by cross tubular braces and having terminal end cross members, one at the foot end and one at the head end of the pad frame. The head end of the pad frame is also supported by a rectangularly shaped head leg frame hingedly attached adjacent the head end cross piece. The head leg frame is similar to the foot leg frame except that vertically adjustable barbell receivers telescope up from the top of the two vertical leg members and the cross bracing is wider so the vertical leg members are outside of the pad frame on both sides. For additional frontal support, the bracing in the head leg frame consists of two vertical tubular members which are connected centrally, spaced between an elongated horizontal foot member and a crosswise top member on which the head end of the pad frame rests. The pad frame extends a short distance past the head leg top cross support member and is pivotally attached to the head leg top cross support member. For stability, the head leg frame is angle braced by fold up bracing members which are retained in an opened or a folded position by centrally position snap hinges. The angled fold up braces attached pivotally midway to the head leg frame structure and to a cross brace attached between the longitudinal side tubular members of the pad frame. This is similar to the foot leg frame bracing which is also retains the foot leg frame in a folded or an unfolded position by snap hinges. Three cross braces between the longitudinal side tubular members of the pad frame add stability to the pad or bench board. The supporting posts of barbell receivers are vertically adjustable and a removable cross piece between the receiver posts can be raised with the raising of the receiver posts and provides an adjustable support for the back rest of the pad. For use, the foot and head leg frames are unfolded into a vertical position one supporting each end of the pad frame with the pad frame in a horizontal position. The posts of the barbell receivers can be adjusted up or down and fastened into a desired position by inserting pins into a single adjustment aperture position in the top walls of the vertical legs with the barbell receivers in a desired position. The receiver posts have multiple adjustment apertures for this purpose. The removable cross piece between the receiver posts allows the back rest section of the pad to be raised for exercising purposes.

Consequently, it should be understood that a principal object of this invention is to provide a weight lifter's bench with a light weight frame which adequately supports a weight lifter's body and bar bells and is foldable to a near flat position for storage particularly for storage under a bed.

Another object or our invention is to provide a foldable weight lifter's bench which includes adjustable barbell receivers that are a part of and can be folded with a foldable bench frame.

A further object of this invention is to provide a weight lifter's foldable bench with a hinged bench pad and provisions for raising and lowering a back rest section of the bench pad relative to the position of the barbell receivers to provide utility in the bench structure for weight lifters of different body sizes.

Other objects and the many advantages of our foldable weight lifter's bench will become understood by reading descriptions of numbered parts in the specification and viewing like numbered parts illustrated in the included drawings.

DESCRIPTION OF THE PREFERRED EMBODIMENT

Figure 1:
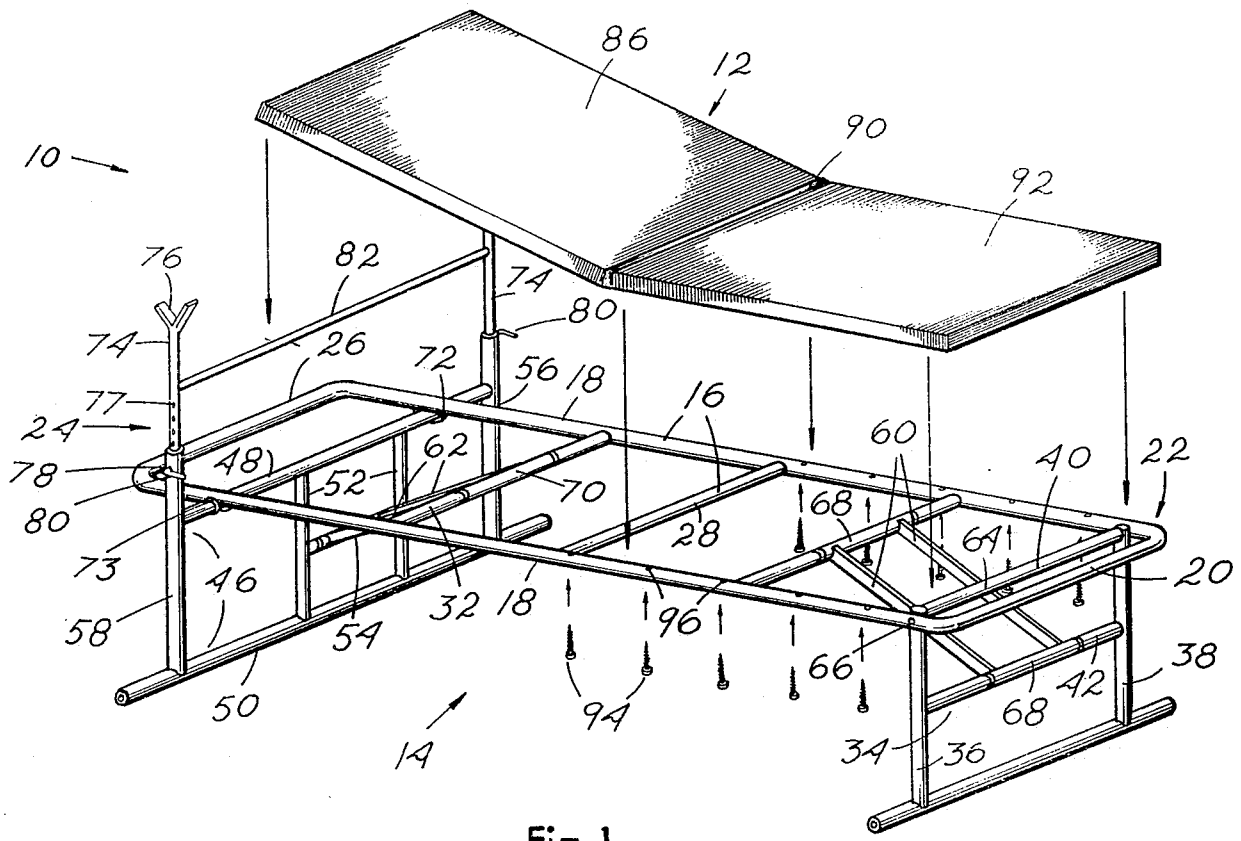
FIG. 1 is a perspective side view of a foldable weight lifter's bench according to the invention. The hinged pad which has a cushioned top and a solid backing is shown positioned over the foldable frame unfolded for use. The foot section of the pad would normally be attached to the foot section of the pad support frame as indicated by attachment arrows. The vertical adjustment provided for the barbell receivers is illustrated.

Referring now to the drawings at FIG. 1 where a foldable weight lifter's bench according to the invention, generally designated lifter's bench 10, is illustrated in a perspective side view. Lifter's bench 10 has two basic components: a bench pad, pad 12, and a folding frame, foldable frame 14. As foldable frame 14 has the more complicated features, it is described first in the following. In the FIG. 1 illustration, pad 12 is shown positioned above foldable frame 14 ready for attachment to pad frame 16 the horizontal pad support frame platform of foldable frame 14. Pad frame 16 has two longitudinal pad frame members 18 which position in parallel alignment horizontally when foldable frame 14 of lifter's bench 10 is unfolded and ready for use. Holding pad frame 16 together is pad frame cross piece foot end member 20 at pad frame foot end 22 and pad frame head end member 26 at pad frame head end 24. The center of pad frame 16 is held together by pad frame center cross tube 28 which is flanked on either side by foot pivotal cross member 30 and head pivotal cross member 32 each positioned about half way between pad frame center cross tube 28 and the two end pieces 20 and 26. Supporting pad frame foot end 22 is foot end leg frame 34 which is comprises of two vertical legs, vertical foot leg 36 and vertical foot leg 38, foot leg frame top horizontal tube 40, pivotal crosswise center tube 42, and foot leg frame base tube 44, which is a base with extended ends on which foot end leg frame 34 rests. Pad frame head end 24 is supported by head end leg frame 46. Pad frame head end 24 rests on top of head leg frame top horizontal tube 48 and is cantilevered a short distance beyond head end leg frame 46. Head end leg frame 46 comprises top horizontal tube 48, an extended end front foot frame base member 50, two vertical pivotal support members 52, a horizontal pivotal bar 54 between the vertical pivotal support members 52, and two vertical legs, head end leg frame vertical leg 56 and head end leg frame vertical leg 58.

Figure 2:
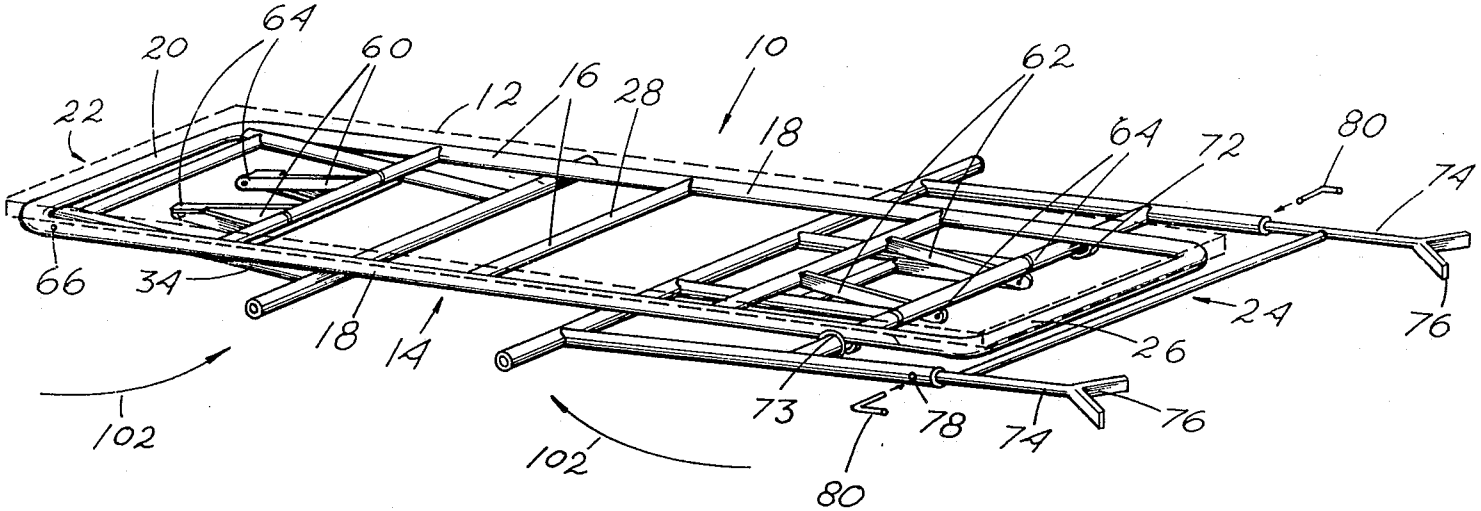
FIG. 2 shows the frame of the FIG. 1 embodiment fully collapsed for storage. The pad is illustrated by dotted lines.

Foldable frame 14 is versatile in that foot end leg frame 34 and head end leg frame 46 can be unfolded for use as illustrated in FIG. 1 or folded for storage as shown in FIG. 2. Movement arrows 102 indicate direction of movement and direction of attachment in the illustrations. When folded for storage or unfolded for use, foot end leg frame 34 and head end leg frame 46 are maintained in position by foot angle leg braces 60 and head angle leg braces 62. Both angled leg braces 60 and 62 are centrally hinged by snap hinges 64 arranged to maintain angle braces 60 and 62 in fixed position when foldable frame 14 is folded or unfolded. For hinging movement, foot end leg frame 34 is attached pivotally to longitudinal pad frame members 18 by pivotal rod 66. Foot angle leg braces 60 are attached to pivotal section 68 in foot leg frame pivotal crosswise center tube 42 and to pivotal section 68 in pad frame foot pivotal cross member 30. For hinging movement, head end leg frame 46 is pivotally attached by brackets 72 under longitudinal pad frame members 18 which are fastened pivotally to head leg frame top horizontal tube 48. Longitudinal pad frame members 18 rest on top of head leg frame top horizontal tube 48 and cantilever a short distance past the attachment. Retainer rings 73 affixed to head leg frame top horizontal tube 48 outside of brackets 72 prevent pad frame 16 from moving laterally. Head angled leg braces 62 are fastened to pivotal section 70 which is a center pivotal section of head pivotal cross member 32.

Two barbell receiver posts 74 affixed at top free ends with V-shaped bar bell receivers 76 operate in a telescoping arrangement with head end leg frame vertical leg 56 and head end leg frame vertical leg 58. Barbell receiver posts 74 are slidably fitted into the opened exposed top ends one in each of head end leg frame vertical leg 56 and head end leg frame vertical leg 58. Barbell receiver posts 74 are vertically adjustable by adjustment apertures 77 in barbell receiver posts 74 being aligned with lock apertures 78 in the upper wall of each vertical leg 56 and 58 and retained by a removable pin 80. A second use for adjustment apertures 77 in barbell receiver posts 74 is adjustable emplacement of removable cross bar 82. Removable cross bar 82 has controllable spring biased end rods 84 which can be snapped into adjustment apertures 77 positioning cross bar 82 in a desired location between barbell receiver posts 74. Cross bar 82 acts as an adjustable backrest support for backrest section 86 of bench pad 12 described further on in this specification. Cross bar 82 could be permanently fastened between barbell receiver posts 74 as shown in FIG. 1 and FIG. 2, but when cross bar 82 is removable and adjustable as illustrated in FIG. 3 and FIG. 4, weight lifter 88 can adjust the distance between himself and the position of barbell 104 in V-shaped barbell receivers 76.

Foldable frame 14 is particularly designed as a supporting structure for pad 12. Pad 12 is structured similar to regulation slant boards having a hard back and a covered padded surface. Usually, the covering is vinyl. As can be seen in the illustrations at FIG. 1 and FIG. 3, pad 12 is divided into two sections by transverse hinge 90 at a central position producing leg rest section 92 and backrest section 86. Leg rest section 92 attaches permanently by bolts 94 through bolt apertures 96 to longitudinal pad frame members 18. Backrest section 86 has a head end which is free to be raised and lowered. As mentioned previously, the free end of backrest section 86 can be adjusted to a desired angle by it being rested on crossbar 82.

Figure 3:
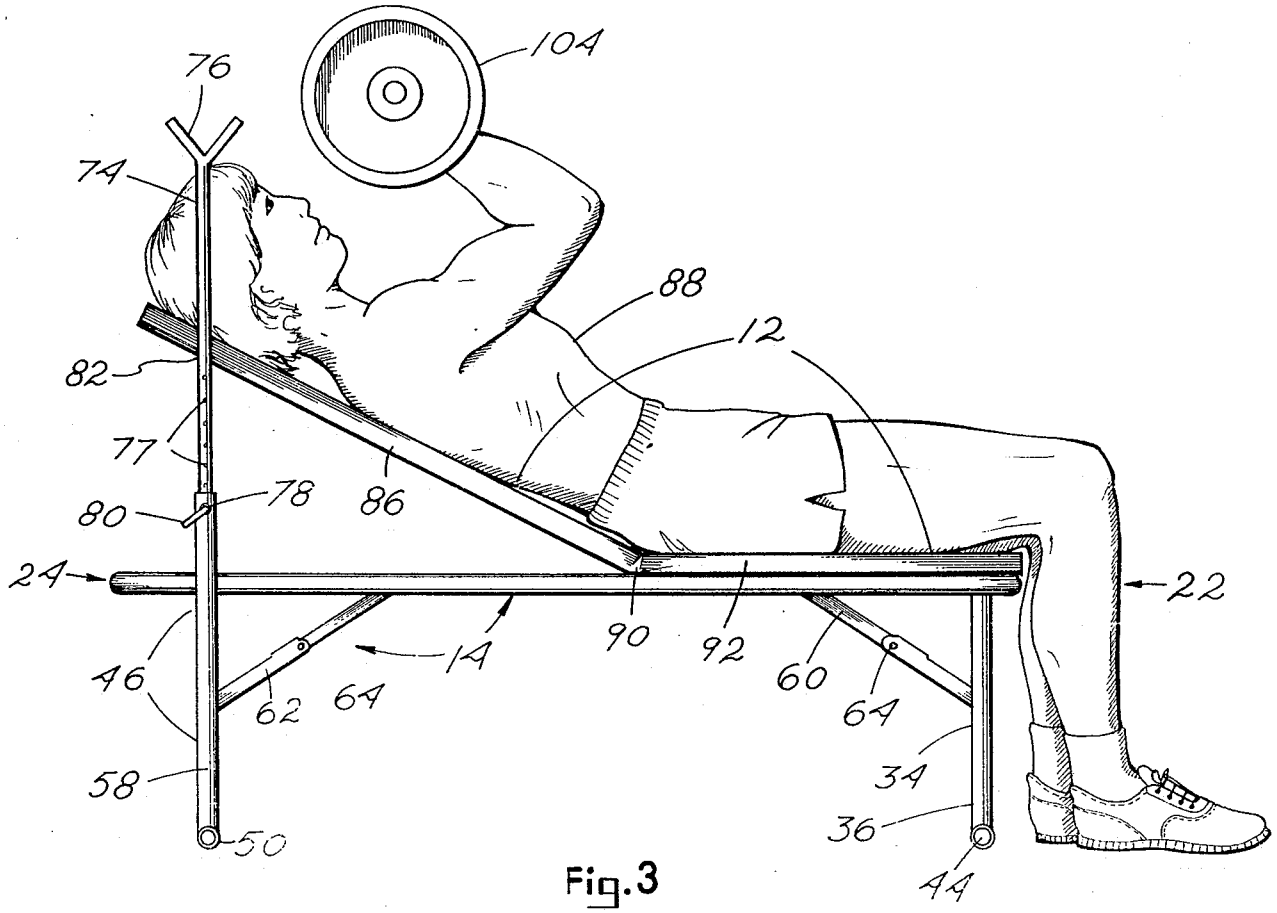
FIG. 3 is a perspective view of the foldable weight lifter's bench according to the invention unfolded and in use.

In use, as illustrated in FIG. 3, foot end leg frame 34 and head end leg frame 46 are snapped into a vertical position retained by snap hinges 64. This positions pad frame 16 horizontally with the bench pad, pad 12, on top. Barbell receiver posts 74 are adjusted so V-shaped barbell receivers 76 position bar bells 104 where weight lifter 88 wants them relative to the angle positioning of backrest 86 with backrest 86 resting on removable cross bar 82. Weight lifter 88 can then use lifter's bench 10 for various weight lifting exercises.

Figure 4:
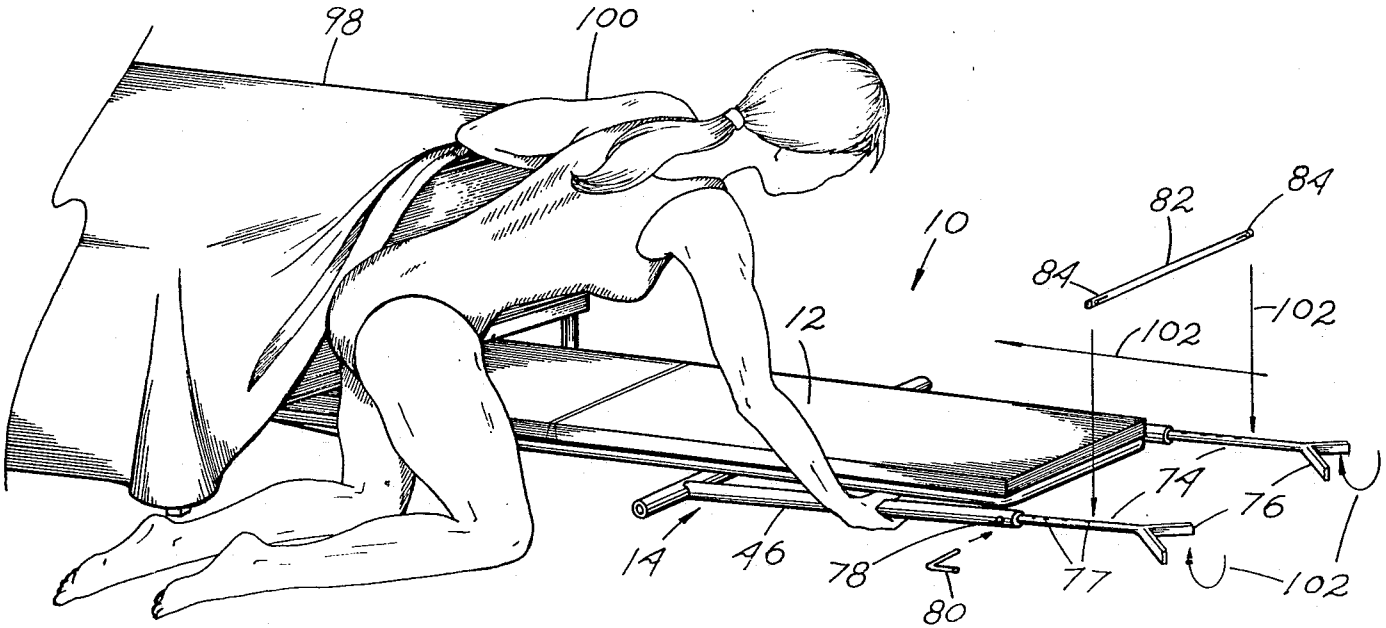
FIG. 4 shows the foldable weight lifter's bench in a folded position and being stored under a bed

For storage as illustrated in FIG. 4, foot end leg frame 34 and head end leg frame 46 are folded down under pad frame 16 and again retained by snap hinges 64. Barbell receiver posts 74, which fold right with foldable frame 14, are released by removing pins 80 from lock apertures 78 and are turned so V-shaped bar bell receivers 76 will be flat against a floor surface. With foldable frame 14 folded in this flat position, lifter's bench 10 can easily be stored under bed 98 by girl 102 as illustrated.

Although we have described a particular embodiment of our invention with considerable details in the foregoing specification and illustrated it in the drawings, it is to be understood that we may practice modifications in the invention so long as any modifications made by us remain within the intended scope of the appended claims and any similar modified devices made by others which fall within our claim scope will be considered our invention.

What we claim as our invention is:

1. A light-weight, foldable weight lifter's bench comprising in combination:

(a) a tubular pad support frame, said pad support frame being generally rectangular having two longitudinal side members and two end members forming a one-piece continuous tubular peripheral frame cross braced centrally by spaced tubular members, there being a head end and a foot end thereof;

(b) a foot end leg frame, said foot end leg frame being a generally rectangular tubular structure centrally cross braced and hingedly attached at a first end and fitting freely inside said two longitudinal side members of said pad support frame adjacent said foot end thereof, said foot end leg frame pivotally movable from a right angle relationship to said two longitudinal side members of said pad support frame to a substantially parallel position relative to said two longitudinal side members of said pad support frame, there being a transverse tubular base member for supporting said foot end leg frame against a surface terminally positioned across a second end of said foot end leg frame, said tubular base member being a stabilizer with ends extended a distance wider than the general width of said foot end leg frame;

(c) a head end leg frame, said head end leg frame being a generally rectangular tubular structure centrally cross braced and hingedly attached at a cross member to said pad support frame adjacent said head end thereof, said head end leg frame pivotally movable for folding from a right angle relationship to said two longitudinal side members of said pad support frame to a substantially parallel position relative to said two longitudinal side members of said pad support frame, there being a tubular base member for supporting said head end leg frame against a surface terminally across a free end of said head end leg frame, said tubular base member being a stabilizer with ends extended a distance wider than a general width of said head end leg frame, said head end leg frame having two opposite side members diametrically enlarged and elongated with free ends projecting a distance beyond said two longitudinal side members of said pad support frame when said head end leg frame is right angled to said two longitudinal side members of said pad support frame, said diametrically enlarged side members being opened at terminal end of said projecting ends;

(d) two tubular barbell bar supports, said two barbell bar supports being elongated tubular members sized to telescope inside of said diametrically enlarged side members of said front end leg frame and each tubular barbell bar support being adjustable relative to a length of each extending from said opened projecting ends of said leg frame members, said two tubular barbell bar supports having fixtures for cooperatively retaining said barbells therein;

(e) releasable locking means for retaining said foot end leg frame and said head end leg frame in said right angle relationship to said two longitudinal side members of said pad support frame and in said substantially parallel position relative to said two longitudinal side members of said pad support frame;

(f) releasable locking means for maintaining said tubular barbell bar supports in an adjusted position relative to said opened projecting ends of said diametrically enlarged head end leg frame members;

(g) a pad, said pad having a top surface and a bottom surface and narrow peripheral sides, said top surface and said bottom surface being substantially rectangular and divided into a backrest section and a leg rest section by a substantially centered transverse hinge allowing angling of said backrest section relative to said adjustably positioned tubular barbell supports;

(e) supporting means providing adjustable elevation of said backrest section of said pad concurrent with elevational adjustment of said two tubular barbell bar supports.

2. The weight lifter's bench of claim 1 wherein said releasable locking means for retaining said foot end leg frame and said head end leg frame in said right angle relationship to said two longitudinal side members of said pad support frame and in said substantially parallel position relative to said two longitudinal side members of said pad support frame includes a cross member in each of said head and foot leg frames, and a pair of cross members in said pad support frame, and spring biased centrally hinged braces pivotally attached between each cross member in said head and foot leg frame and a respective cross member in said pad support frame.

3. The weight lifter's bench of claim 1 wherein said releasable locking means for adjustably retaining said tubular barbell bar supports includes oppositely positioned single apertures in both said diametrically enlarged leg frame members and a row of apertures in said tubular barbell bar support, the apertures in said tubular barbell bar support being selectively alignable with said single apertures in both said diametrically enlarged leg frame members, and a pin for releasably retaining said apertures in a selected alignment.

4. The weight lifter's bench of claim 1 wherein said two tubular barbell bar supports are removable from said diametrically enlarged side members of said front end leg frame.

5. The weight lifter's bench of claim 1 wherein said two tubular barbell bar supports fold concurrently with said head end leg frame when said two tubular barbell bar supports remain in said diametrically enlarged side members of said front end leg frame during said folding.

6. The weight lifter's bench of claim 1 wherein said supporting means providing adjustable elevation of said backrest section of said pad concurrent with elevational adjustment of said two tubular barbell bar supports is a rod for resting said backrest section of said pad thereon attached between said two tubular barbell bar supports positioned above said releasable locking means for adjustably retaining said tubular barbell bar supports relative to said opened projecting ends of said diametrically enlarged leg frame members.

7. The weight lifter's bench of claim 1 wherein said frame members are formed of a light weight material.

8. The weight lifter's bench of claim 7 wherein said light weight material is aluminum tubing.

9. The weight lifter's bench of claim 1 wherein said pad bottom surface is a hard backing and said top surface is a padded covering, said padded covering being the thickness of said narrow peripheral sides.

* * * * *